US005454520A

United States Patent [19]

Folsberg

[11] Patent Number: 5,454,520

[45] Date of Patent: Oct. 3, 1995

[54] METHOD FOR CONTROLLING THE MATERIAL FEED TO A ROLLER PRESS FOR GRINDING PARTICULATE MATERIAL

[75] Inventor: Jan Folsberg, Copenhagen, Denmark

[73] Assignee: F. L. Smidth & Co. A/S, Denmark

[21] Appl. No.: 211,356

[22] PCT Filed: Oct. 12, 1992

[86] PCT No.: PCT/DK92/00298

§ 371 Date: Mar. 23, 1994

§ 102(e) Date: Mar. 23, 1994

[87] PCT Pub. No.: WO93/08915

PCT Pub. Date: May 13, 1993

[30] Foreign Application Priority Data

Nov. 1, 1991 [DK] Denmark ..... 1804/91

[51] Int. Cl.[6] ..... B02C 23/02

[52] U.S. Cl. ..... 241/30; 241/34

[58] Field of Search ..... 241/30, 34, 35

[56] References Cited

U.S. PATENT DOCUMENTS 2,136,907 11/1938 Roder .
2,952,414 9/1960 Williamson .
3,314,614 4/1967 Daniel et al. .
3,996,452 12/1976 Schulze et al. .
4,151,588 4/1979 Hammer .
4,611,763 9/1986 Tomiyasu et al. .
4,869,434 9/1989 Folsberg ..... 241/34

FOREIGN PATENT DOCUMENTS 2362434 4/1978 France .
226542 5/1969 Sweden .
782523 2/1955 United Kingdom .

*Primary Examiner*—Timothy V. Eley
*Attorney, Agent, or Firm*—Brumbaugh, Graves, Donohue & Raymond

[57] ABSTRACT

For controlling the material feed to a roller press, a method is described, whereby the difference between the operating values of a roller press before and after a forced change in the material feed is used to establish whether the material feed should be increased, reduced or maintained unchanged in order to optimize the operation of the roller press. By this method it is obtained that the roller press, regardless of the homogeneity of the feed material, will constantly be operating within the transition range between starve and shaft feeding and that, consequently, the roller press can be utilized to optimum extent, while simultaneously avoiding the fluidization problems associated with shaft feeding.

22 Claims, 1 Drawing Sheet

METHOD FOR CONTROLLING THE MATERIAL FEED TO A ROLLER PRESS FOR GRINDING PARTICULATE MATERIAL

BACKGROUND OF THE INVENTION

The present invention relates to a method for controlling the material feed to a roller press for grinding particulate material, by which method the following stages are taken in succession:

1) a first value indicating the operating mode of the roller press is measured during the roller press operation 2) the material .feed rate to the roller press is forcibly changed 3) the new value indicating the operating mode of the roller press is measured during the roller press operation 4) the calculated differential value is compared with a first prefixed numerical value and a second prefixed numerical value, the second prefixed numerical value being greater than the first prefixed numerical value, and the material feed rate to the roller press as a function hereof is either reduced, increased or maintained unchanged.

5) the material feed rate to the roller press as a function of the calculated differential value is either reduced, increased or maintained unchanged.

A roller press of the above kind and its function are known from, for example, U.S. Pat. No. 4,357,287.

In principle, material may be fed to the roller press in two ways, viz. by shaft feeding or by so-called starve feeding.

In the case of shaft feeding, the entire roller gap and an area thereabove is filled with material to be ground, enabling the rollers to draw a substantially constant amount of material into the gap between the rollers. Since, simultaneously, the grinding bed thickness/gap width as well as the nip angle are at the maximum attainable levels, and since the feed shaft is never run empty of material, this means that the roller press can be operated at optimum capacity.

However, shaft feeding has the disadvantage, particularly when finish-grinding fine-grained products, that fluidization problems may occur with respect to the material in the feed shaft, hence resulting in irregular and unacceptable roller press operation. Fluidization may, for example, occur as a result of the material in the feed shaft being scavenged by air expelled from the compaction zone of the roller press. The tendency towards fluidization may be reduced to a certain extent by decreasing the roller speed, but this will cause the roller capacity to be correspondingly reduced.

This problem is remedied by means of starve feeding i.e. by reducing the material feed to the roller press to such an extent that the roller gap is not entirely filled with material, thereby avoiding a material column over the rollers. At the same time, this makes it possible to apply a higher roller speed, whereby a higher roller press capacity is obtained.

In the case of starve feeding the material feed rate is normally controlled in a manner ensuring that, during shortage feeding of the roller press, the grinding gap is maintained at a level which is slightly lower than the maximum gap width, so that the feed is reduced in steps of varying magnitude in case of a substantial build-up of material in the feed shaft. However, the roller press is not utilized to full capacity when performing this type of control, since, for reasons of safety, the selected grinding bed thicknesses applied during starve feeding are much lower than the maximum values.

The capacity of the roller press may be improved by controlling the material feed to the roller press as a function of the deviation from a predetermined size of an operating value such as, for example, the gap width or the power consumption. According to this method, a trial run is conducted with the material to be ground in order to establish the maximum size of the operating value according to which the material feed is to be controlled, e.g. the gap width. During operation of the roller press the material feed is subsequently controlled so that this value (e.g. the gap width) is kept at a lower level (10–15%) than the maximum value, being maintained at a substantially constant level, e.g. by means of a PID regulator.

However, this method has the disadvantage that it is an underlying assumption that the material to be ground is reasonably homogeneous, due to the fact that, for example, the gap width and the necessary grinding effect will vary considerably according to variations in the particle distribution, density, porosity or moisture of the material. So, even though the mentioned method may improve the control of the material feed, and hence the roller press operation, it will be difficult to achieve optimum roller press capacity at the same time as the shaft feed problems are avoided.

From the U.S. Pat. No. 4,611,763 a method is known for controlling the material feed to a tube mill for grinding of particulate material, by which method a controller is utilized which controls the material feed to the mill by comparing an initial setpoint input with a signal generated by various monitoring devices. According to the patent specification the output signal of the controller is integrated for a predetermined time whereupon the setpoint is automatically increased a predetermined amount and the new output signal of the controller is integrated for the same predetermined time. The original and the new integrated value are then compared, and if the new value is greater than or equal to the original integrated output value, the setpoint is again automatically increased the predetermined amount and the next new output signal of the controller is integrated for the same predetermined time. The next new value is then compared to the immediately preceding value and if the latter is greater than or equal to the preceding value, the setpoint is again increased automatically. If the last output value obtained from the controller is less than the immediately preceding output value, the setpoint will be decreased the predetermined amount. By this method the setpoint is hence increased or decreased so that the same predetermined amount, depending upon whether the last obtained output value from the controller, is greater than, equal to or less than the immediately preceding value.

If the aforementioned method were to be used for controlling the material feed for a roller press, this would involve a certain risk of the feed shaft being overfilled, since, according to the method, the feed rate will always be increased if two successively performed measurements produce the same result, as would be the case for a roller press operating on shaft feeding.

According to the known method the control operation is further based on the performance of simultaneous measurements of several different operating parameters for the mill, which, on a combined basis, form the basis for the calculation of the efficiency value prior to and subsequent to an effected change in the material feed rate, which prior and subsequent values again form the basis for calculating the value which determines whether the material feed should be increased or decreased. Consequently, the control operation appears to be rather complicated and, further, it is based on a theoretically defined efficiency parameter.

Further, the known method does not allow intervals to be applied between the control sequences since the control sequences overlap one another in that the output value by one control sequence indicates the termination time of one period, whereas the same value by the subsequent control sequence indicates the starting time for the new period.

SUMMARY OF THE INVENTION

It is the object of the present invention to provide an uncomplicated method for controlling the material feed to a roller press in such a manner that the roller press can be utilized to optimum capacity, with simultaneous avoidance of the aforementioned problems associated with shaft feeding, which means that the material feed to the roller press must essentially be maintained at a level which corresponds exactly to the handling capacity of the roller press at any particular time.

According to the .present invention this object is achieved by a method of the kind described in the introduction and being characterized in that the forced change during stage 2) is always a reduction of the material feed rate, that the material feed rate to the roller press during stage 5) is predeterminedly reduced or maintained unchanged if the differential value is numerically less than or equal to the first prefixed numerical value, is maintained unchanged if the differential value is numerically greater than the first prefixed numerical value and less than or equal to the second prefixed numerical value, and is increased if the differential value is numerically greater than the second prefixed numerical value, that both the first value and the new value indicating the operating mode of the roller press result from one and only one predetermined operating parameter for the press, and that the stages 1 to 5 are repeated at a specifically defined time interval.

The invention is based on the recognition that the value of the operating parameters, such as gap width, grinding pressure, power consumption, etc. during starve feeding vary according to the feed rate to the roller press, whereas the values of the corresponding operating parameters during shaft feeding are not instantaneously changed if the feed rate to the roller press is changed, since any such change will only result in a change in the material level in the feed shaft.

By the method according to the invention it is thus possible, by forcing upon the system a reduction in the feed rate and by comparing the operating values of the roller press before and after the reduction, to establish whether the roller press is operating on starve feeding or shaft feeding. If the operating values of the roller press before and after a reduction of the feed rate vary considerably, viewed of course in relation to the size of the forced change, this is an indication that the roller press is operating on starve feeding, and, therefore, it will be possible to increase the material feed rate in order to improve the capacity of the roller press. However, if there is no significant change in the operating values of the roller press when the material feed reduction is forcibly effected, involving, therefore, that the calculated differential value is essentially equal to zero, this indicates that the roller press is operating on shaft feeding with the attendant disadvantages, and, consequently, the feed rate must be reduced or must, at least, be maintained unchanged. The reason why the feed rate can be maintained unchanged even after it has been ascertained that the roller press is operating on shaft feeding is that the material feed during the subsequent control sequence during stage 2) will always involve a forced reduction, which will result in a gradual emptying of the feed shaft. In the transition zone between shaft feeding and starve feeding, the size of the calculated differential values will be such that it is difficult to establish whether the difference measured between the operating values before and after the material feed reduction is due to "noise" from the variations inevitably occurring or due to a specific change in operating conditions, and, therefore, according to the invention it will be possible to define a transition interval for the differential value within which the material feed rate must always remain unchanged.

So, by the method according to the invention, the material feed to the roller press can be controlled so that the feed rate is constantly maintained in the transition range between starve feeding and shaft feeding, hence avoiding the problems associated with shaft feeding, while optimum utilization of the roller press capacity is simultaneously obtained.

Further, the method according to the invention will ensure that the material feed rate is not increased when the roller press is operating on shaft feeding and when the differential value between two successively recorded values for the roller press operation is, therefore, equal to zero. In actual practice, the method will, in the case of shaft feeding, provide for a gradual reduction in the amount of material in the feed shaft, and ensure that the feed rate to the roller press is reduced, either instantaneously on ascertaining that shaft feeding is being applied or during the subsequent control sequence.

Unlike the known method where the signal indicating the condition of the mill is generated as a result of at least two operating parameters, the method according to the invention makes it possible to control the material feed in order to optimize the roller press operation, this being done solely by recording the change of one predetermined operating parameter through a forced change of the material feed rate.

Since each control sequence cycle according to the invention is always re-started from the initial starting point at stage 1) and due to its independence of the preceding control sequence, intervals of arbitrary length may be applied between the single control sequences. This cannot be done with the known method, where the last calculated output value is initially utilized for comparison with the immediately preceding output value and subsequently utilized for comparison with an immediately ensuing output value. As a result, the control sequences by the known method overlap one another in that the output value by one control sequence indicates the termination time of one period, whereas the same value by the subsequent control sequence indicates the starting time for the new period.

The operating value selected for measuring could be the torque (e.g. by measuring the current consumption of the motor), the power consumption, the grinding pressure, or the gap width of the roller press. Since these values will exhibit variations according to the homogeneity of the feed material, it is further preferred that measurements be performed over a period of time and that the operating value is calculated as an average value over this period.

In order to ensure a smooth and stable operation of the roller press, substantial changes in the material feed rate to the press should not be made, and according to the invention it is therefore preferred to approximate the material feed rate to the optimum condition, with each change being of the order 0 to 10%, preferably 0 to 5% of the feed rate.

Having ascertained that the roller press is operating on starve feeding and that, consequently, an increase in the material feed rate is required to attain approximation to the optimum operating situation of the roller press, it should be ensured that such an increase in the material feed rate is greater than the reduction in the feed rate which is forcibly effected during stage 2 of the control sequence.

The homogeneity of the materials to be ground will, of course, also be an influencing factor on the frequency and intensity of the changes effected relative to the measured operating values of the roller press. When grinding extremely inhomogeneous materials, frequent adjustments of the material feed rate must be made, whereas the situation is precisely the reverse when grinding homogenous material. Depending upon the homogeneity of the materials, it therefore preferred that the steps 1 to 5 are repeated at a time interval between 0 and 600 seconds, preferably between 0 and 180 seconds.

Since the operating values of a roller press may vary considerably depending upon the nature of the feed material, it is preferred, in some cases, to express the calculated differential value as a relative difference between the operating value of the roller press prior to and subsequent to the change in the material feed rate.

Despite the fact that the roller press is operating on shaft feeding during several measuring periods, it can hardly be expected that the average operating values for the measuring periods will be exactly the same so that the value of the calculated difference is exactly zero, and, therefore, it is preferred according to the invention that the material feed rate to the roller press is predeterminedly reduced or maintained unchanged unchanged if the relative differential value is less than 1%, preferably less than 0.1% and most preferably less than 0.05%, that the feed rate is maintained unchanged if the differential value is between 1 and 3%, preferably between 0.1 and 1% and most preferably between 0.05 and 0.1%, and that the material feed rate to the roller press is increased if the differential value exceeds the upper limit value of the said interval.

Sudden and substantial changes in the properties of the material may result in large and undesirable leaps in the operating values, consequently leading to operational problems, and, further, large lumps of material may cause the roller press to be obstructed, and, according to the invention, it is therefore preferred that the amount of material being fed to the roller press is reduced or stopped if the material column in the feed shaft exceeds a given level.

BRIEF DESCRIPTION OF THE DRAWINGS

The invention will now be described in further details with reference to the accompanying drawing, being diagrammatical, and where.

DESCRIPTION OF THE PREFERRED EMBODIMENT

Figure 1:
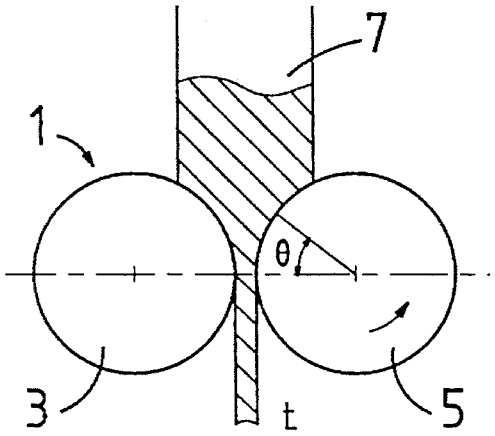
FIG. 1 shows an elementary sketch for shaft feeding of a roller press.

FIG. 1 shows an elementary sketch for shaft feeding of a roller press 1, which comprises two oppositely rotating rollers 3 and 5. The material to be ground is supplied via a feed shaft 7 which simultaneously serves as a buffer store. Hence, the roller gap between rollers 3 and 5 and an area thereabove will always be filled with material, thus enabling the rollers 3, 5 to draw a substantially constant amount of material into the roller gap, hence obtaining both a maximum grinding bed thickness $t_{max}$ and a maximum nip angle $\theta_{max}$, so that maximum utilization of the roller press capacity is obtained. The values of $t_{max}$ og $\theta_{max}$ depend on the properties of the feed material, such as density and moisture, and on the surface characteristics of the rollers.

Figure 2:
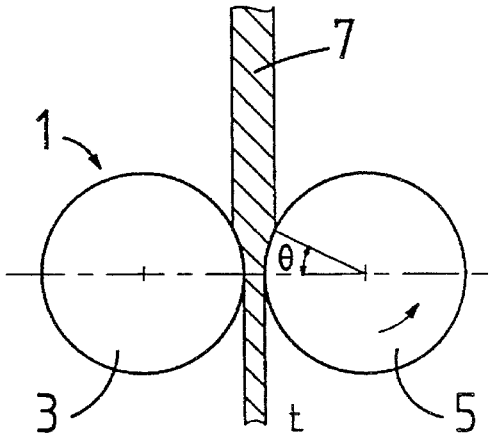
FIG. 2 shows an elementary sketch for starve feeding of a roller press.

FIG. 2 shows a similar elementary sketch for starve feeding of the roller press 1. The material to be ground may either be supplied via a feed shaft 7 or directly from a proportioning device, not shown. If starve feeding is applied, it is essential to ensure that the material feed rate is constantly maintained at a level which is less than or equal to the amount which can theoretically be ground by the roller press, and, therefore, the actual values of t and $\theta$ in this operating mode will always be less than or equal to the maximum attainable values for $t_{max}$ and $\theta_{max}$ subject to the given preconditions.

Figure 3:
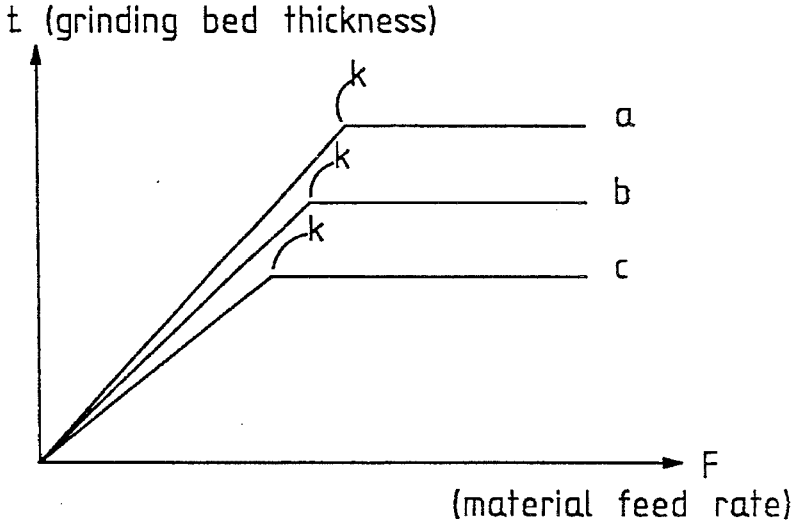
FIG. 3 shows operating curves for a roller press, where the grinding bed thickness is illustrated as a function of the material feed rate.

FIG. 3 shows three different operating curves a, b and c for a roller press, where one of operating values of the roller press, which in this case is the grinding bed thickness t, is shown as a function of the material feed rate F. As indicated, all curves have a break point k which separates an inclined line and a horizontal line. The break point marks the transition from starve feeding to shaft feeding and it represents the point on the operating curve towards which it is desirable to control the roller press operation by the method according to the invention.

The curve b in FIG. 3 indicates the operating curve when grinding an "average material", whereas the curve a indicates the operating curve when grinding a material having a higher density and a lower moisture and where a higher degree of friction occurs between the rollers and the material, and the curve c indicates the operating curve when grinding a material having a lower density and a higher moisture and where a lower degree of the friction occurs between the rollers and the material. However, the curves indicate only the influence of the operating conditions on the given operating curve, which, in actual practice, will vary continuously.

Given that there is substantially proportionality between the grinding bed thickness and the power consumption of the roller press, corresponding curves will apply to the power consumption of the roller press as a function of the feed rate.

Figure 4:
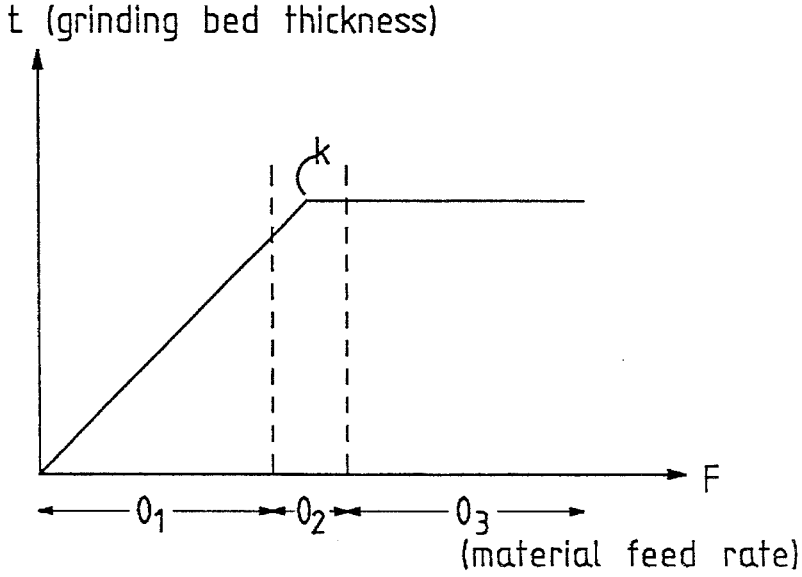
FIG. 4 shows an operating curve for a roller press, on which the control principle according to the invention is outlined.

FIG. 4 shows an arbitrary operating curve for a roller press. Here the curve is divided into three ranges $O_1$, $O_2$ and $O_3$, where range $O_1$ indicates the feed rate interval within which the roller press is operating on starve feeding, whereas range $O_2$ indicates the transition interval between starve feeding and shaft feeding and where range $O_3$ indicates the upwards open interval within which the roller press is operating on shaft feeding.

By means of the method according to the invention it is possible without any prior knowledge of the actual operating curve to establish whether the roller press is operating within range $O_1$ or $O_3$ and whether the feed rate should be increased, reduced or maintained constant. According to the invention this is done by measuring the instantaneous operating value of the roller press, by reducing the feed rate and by measuring the new operating value. In case of variations between the measured operating values, this is an indication that the roller press is operating within a range on the operating curve where the inclination coefficient differs from zero and that the roller press is therefore operating within the starve feeding range $O_1$ so that the feed rate can be increased.

However, if there is identity between the two operating values which are measured, this is an indication that the curve inclination coefficient is equal to zero and that the roller press is operating within the range $O_3$, i.e. on shaft feeding, and, consequently, the feed rate must be reduced.

Hence, the operation of the roller press will constantly move towards the range $O_2$, preferably attaining stability within this range after a certain period of time, so that the mode of feeding is constantly fluctuating between "moderate" shaft feeding and "moderate" starve feeding.

By reducing the percentage change of the material feed, while simultaneously increasing the frequency at which the change is effected, the scope of range $O_2$ may be minimized so that the roller press is essentially operating at the break point of the operating curve.

I claim:

1. A method for controlling the material feed to a roller press for grinding particulate material, by which method the following stages are taken in succession:

1) a first operating value indicating the operating mode of the roller press is measured during the roller press operation 2) the material feed rate to the roller press is forcibly changed 3) a second operating value indicating the operating mode of the roller press is measured during the roller press operation 4) the difference between the measured operating values indicating the operating mode of the roller press is calculated, and 5) the calculated differential value is compared with a first prefixed numerical value and a second prefixed numerical value, the second prefixed numerical value being greater than the first prefixed numerical value, and the material feed rate to the roller press as a function hereof is either reduced, increased or maintained unchanged, characterized in that the forced change during stage 2) is always a reduction of the material feed rate, that the material feed rate to the roller press during stage 5) is predeterminedly reduced or maintained unchanged if the differential value is numerically less than or equal to the first prefixed numerical value, is maintained unchanged if the differential value is numerically greater than the first prefixed numerical value and less than or equal to the second prefixed numerical value, and is increased if the differential value is numerically greater than the second prefixed numerical value, that both the first value and the new value indicating the operating mode of the roller press result from one and only one predetermined operating parameter for the press, and that the stages 1 to 5 are repeated at a specifically defined time interval.

2. A method according to claim 1, characterized in that either the torque, power consumption, grinding pressure or gap width of the roller press is measured as the operating values of the roller press.

3. A method according to claims 1 or 2, characterized in that each of the operating values is measured as an average value over a given period of time.

4. A method according to claim 3, characterized in that the material feed rate to the roller press is reduced or stopped if the material column in the feed shaft exceeds a given level.

5. A method according to claim 2, characterized in that the material feed rate to the roller press is reduced or stopped if the material column in the feed shaft exceeds a given level.

6. A method according to claim 1, characterized in that the change of the material feed rate is of the order 0 to 10% of the feed rate.

7. A method according to claim 6, characterized in that the material feed rate to the roller press is reduced or stopped if the material column in the feed shaft exceeds a given level.

8. A method according to claim 6, characterized in that the change of the material feed rate is of the order 0 to 5% of the feed rate.

9. A method according to claim 8, characterized in that the material feed rate to the roller press is reduced or stopped if the material column in the feed shaft exceeds a given level.

10. A method according to claim 1, characterized in that the time interval is between 0 and 600 seconds.

11. A method according to claim 10, characterized in that the material feed rate to the roller press is reduced or stopped if the material column in the feed shaft exceeds a given level.

12. A method according to claim 10, characterized in that the time interval is between 0 and 180 second.

13. A method according to claim 12, characterized in that the material feed rate to the roller press is reduced or stopped if the material column in the feed shaft exceeds a given level.

14. A method according to claim 1, characterized in that the differential value is calculated as the percentage difference between the first and second operating value.

15. A method according to claim 14, characterized in that the material feed rate to the roller press is reduced or stopped if the material column in the feed shaft exceeds a given level.

16. A method according to claim 14, characterized in that in stage 5) the material feed rate to the roller press is predeterminedly reduced or maintained unchanged if the differential value is less than 1%, is maintained unchanged if the differential value is between 1 and 3%, and that the material feed rate to the roller press is increased if the differential value is greater than 3%.

17. A method according to claim 16, characterized in that the material feed rate to the roller press is reduced or stopped if the material column in the feed shaft exceeds a given level.

18. A method according to claim 14, characterized in that in stage 5) the material feed rate to the roller press is predeterminedly reduced or maintained unchanged if the differential value is less than 0.1%, is maintained unchanged if the differential value is between 0.1 and 1%, and that the material feed rate to the roller press is increased if the differential value is greater than 1%.

19. A method according to claim 18, characterized in that the material feed rate to the roller press is reduced or stopped if the material column in the feed shaft exceeds a given level.

20. A method according to claim 14, characterized in that in step 5) the material feed rate to the roller press is predeterminedly reduced or maintained unchanged if the differential value is less than 0.05%, is maintained unchanged if the differential value is between 0.05 and 0.1%, and that the material feed rate to the roller press in increased if the differential value is greater than 0.1%.

21. A method according to claim 20, characterized in that the material feed rate to the roller press is reduced or stopped if the material column in the feed shaft exceeds a given level.

22. A method according to claim 1, characterized in that the material feed rate to the roller press is reduced or stopped if the material column in the feed shaft exceeds a given level.

* * * * *